US005228597A

United States Patent [19]

Low

[11] Patent Number: 5,228,597

[45] Date of Patent: Jul. 20, 1993

[54] FLOW VALVE ARRANGEMENT FOR BEVERAGE DISPENSER

[75] Inventor: Michael Low, Norcross, Ga.

[73] Assignee: Wilshire Partners, Cleveland, Ohio

[21] Appl. No.: 942,034

[22] Filed: Sep. 8, 1992

[51] Int. Cl.[5] ..... B67D 5/56

[52] U.S. Cl. ..... 222/129.1; 222/504; 137/630.15

[58] Field of Search ..... 222/129.1-129.4; 137/630.15, 504; 141/128

[56] References Cited

U.S. PATENT DOCUMENTS

| | | | |
|---|---|---|---|
| 3,343,721 | 9/1967 | Paley | 137/630.15 X |
| 3,888,280 | 6/1975 | Tartaglia | 137/630.15 X |
| 4,266,726 | 5/1981 | Brown et al. | 239/406 |
| 4,274,444 | 6/1981 | Ruyak | 137/630.15 X |
| 4,418,848 | 12/1983 | Lunau | 222/504 |
| 4,481,776 | 11/1984 | Araki et al. | 137/630.15 X |
| 4,903,740 | 2/1990 | Corniea et al. | 222/504 X |
| 5,022,427 | 6/1991 | Churchman et al. | 137/630.15 X |

*Primary Examiner*—Andres Kashnikow
*Assistant Examiner*—Kenneth DeRosa
*Attorney, Agent, or Firm*—Body, Vickers & Daniels

[57] ABSTRACT

A beverage dispenser of the type having a diluent mixed with a syrup to produce the beverage to be dispensed is provided with a solenoid actuated valve arrangement between the diluent and/or syrup supply line and the dispensing nozzle and which solenoid valve has a sealing arrangement which, upon actuation of the solenoid, provides sequential first and second stages of pressure drop across the valve seat, thus to reduce the power required to operate the solenoid and open the valve or enable the valve to operate under higher fluid pressures without increasing the power of the solenoid.

16 Claims, 5 Drawing Sheets

FLOW VALVE ARRANGEMENT FOR BEVERAGE DISPENSER

BACKGROUND OF THE INVENTION

This invention relates to the art of post-mix beverage dispensers and, more particularly, to improved solenoid actuated valves for controlling the flow of a diluent and a syrup which are mixed to produce the beverage to be dispensed.

Post-mix beverage dispensers are well known and, for example, are basically of the structure and operation shown in U.S. Pat. No. 4,266,626 to Brown et al, the disclosure of which is incorporated herein by reference for background purposes. In a post-mix dispenser of the foregoing character, a diluent such as soda water and a syrup flow into the body of the dispenser through separate inlet passageways and across corresponding flow rate control valves toward a mixing area which is generally associated with the nozzle of the dispenser. Flow from the inlets to the nozzle is controlled by a pair of solenoid valves, one for each of the liquids, and a drink is dispensed by pressing a receptacle such as a cup against a control lever which actuates a microswitch by which the solenoid coils are simultaneously energized. Such energization of the solenoid coils opens the vales, whereupon the diluent and syrup flow across the corresponding valve seat and into the nozzle wherein they mix and flow into the receptacle.

Each of the solenoid valves, typically, includes a coil and armature coaxial with the valve seat, and the end of the armature facing the valve seat is provided with a valve element which engages and disengages the valve seat to respectively close and open the valve to the flow of liquid therethrough. The valves are normally closed and are biased to the closed position by a corresponding coil spring and the pressure of the diluent or syrup acting against the valve element and/or armature in a corresponding chamber on the upstream side of the valve seat. The chamber is in constant flow communication with the corresponding source which is under pressure, whereby the liquid in the chamber is under constant pressure.

The power of the solenoid required to open the valve is dependent, in part, on the closing force of the biasing spring and the closing force against the valve element and/or armature by the pressure of the liquid in the chamber on the upstream side of the valve seat. Especially in connection with the diluent, which may be under a pressure from 60 to 125 psi, the closing forces are considerable. Moreover, upon opening of the valve, the sudden flow of the liquid across the valve seat is turbulent and can result in the loss of carbonation which is undesirable in that it is an objective of such post-mix dispensers to dispense the drink with the highest amount of carbonation possible. It will be appreciated that the required power for opening the solenoid valve increases with higher liquid pressures, as does the turbulence of flow when the valve is opened, whereby the potential for loss of carbonation in connection with the soda water also increases with increasing pressure. In connection with both syrup and diluent flow, turbulence of flow across the valve seat restricts the flow and thus can reduce the quantity of flow of either or both during the period that the valves are open. This makes it difficult to consistently obtain the desired mix of syrup and diluent for the beverage being dispensed.

SUMMARY OF THE INVENTION

In accordance with the present invention, a solenoid valve structure is provided for a post-mix beverage dispenser which advantageously reduces the power required to open the valve with a given liquid pressure thereagainst, or increases the pressure range for which a given solenoid is operable and, at the same time, controls the pressure drop across the valve seat in a manner which minimizes turbulence in the flow when the valve opens. More particularly in this respect, a solenoid valve in accordance with the present invention is operable in connection with displacement of the armature in the opening direction to provide sequential and distinct stages of pressure drop across the valve seat, thus to avoid the sudden release of liquid under pressure that occurs when solenoid valves heretofore available move from the closed to the open positions thereof. The sequential stages of pressure drop include a first stage during which the solenoid armature is displaced in the opening direction independent of fluid pressure against the valve element, thus to reduce the power required with respect to the solenoid. Such initial displacement of the armature results in flow of fluid from the chamber through a bypass passageway providing the first stage of pressure drop, thus reducing the closing force of the liquid on the valve element. Therefore, full opening of the valve thereafter to provide the second stage of pressure drop can be achieved with the same lower power requirement for the solenoid. Preferably, the two stages of pressure drop are achieved by providing for the valve element to be axially displaceable with and relative to the armature on which it is mounted. During the first stage of pressure drop, the armature moves relative to the valve element and initial liquid flow is across the valve element which remains in engagement with the valve seat. During the second stage of pressure drop, the armature displaces the valve element from the seat whereby liquid flows directly across the valve seat and, preferably, also flows across the valve element. When the valve is closed, the armature engages the valve element against the seat and closes the bypass passageway.

It is accordingly an outstanding object of the present invention to provide an improved solenoid actuated liquid flow control valve for a post-mix beverage dispenser.

Another object is the provision of a solenoid valve of the foregoing character which, for a given liquid pressure thereagainst in the closed position, requires less solenoid power to open than that required with solenoid valves heretofore available.

A further object is the provision of a solenoid valve of the foregoing character which, in opening, provides sequential stages of pressure reduction, thus to reduce turbulent flow and the solenoid power required to open the valve.

Yet another object is the provision of a solenoid valve of the foregoing character which, for a given size solenoid, is operable at higher liquid pressures than heretofore possible.

Yet another object is the provision of a solenoid valve of the foregoing character which provides for relative displacement between the armature and valve element during initial displacement of the armature to open the valve so as to provide a bypass passageway for initial flow of liquid across the valve element and which then provides for displacement of the valve element by the armature to fully open the valve to liquid flow across the valve seat.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawing in which.

DESCRIPTION OF PREFERRED EMBODIMENTS

Figure 1:
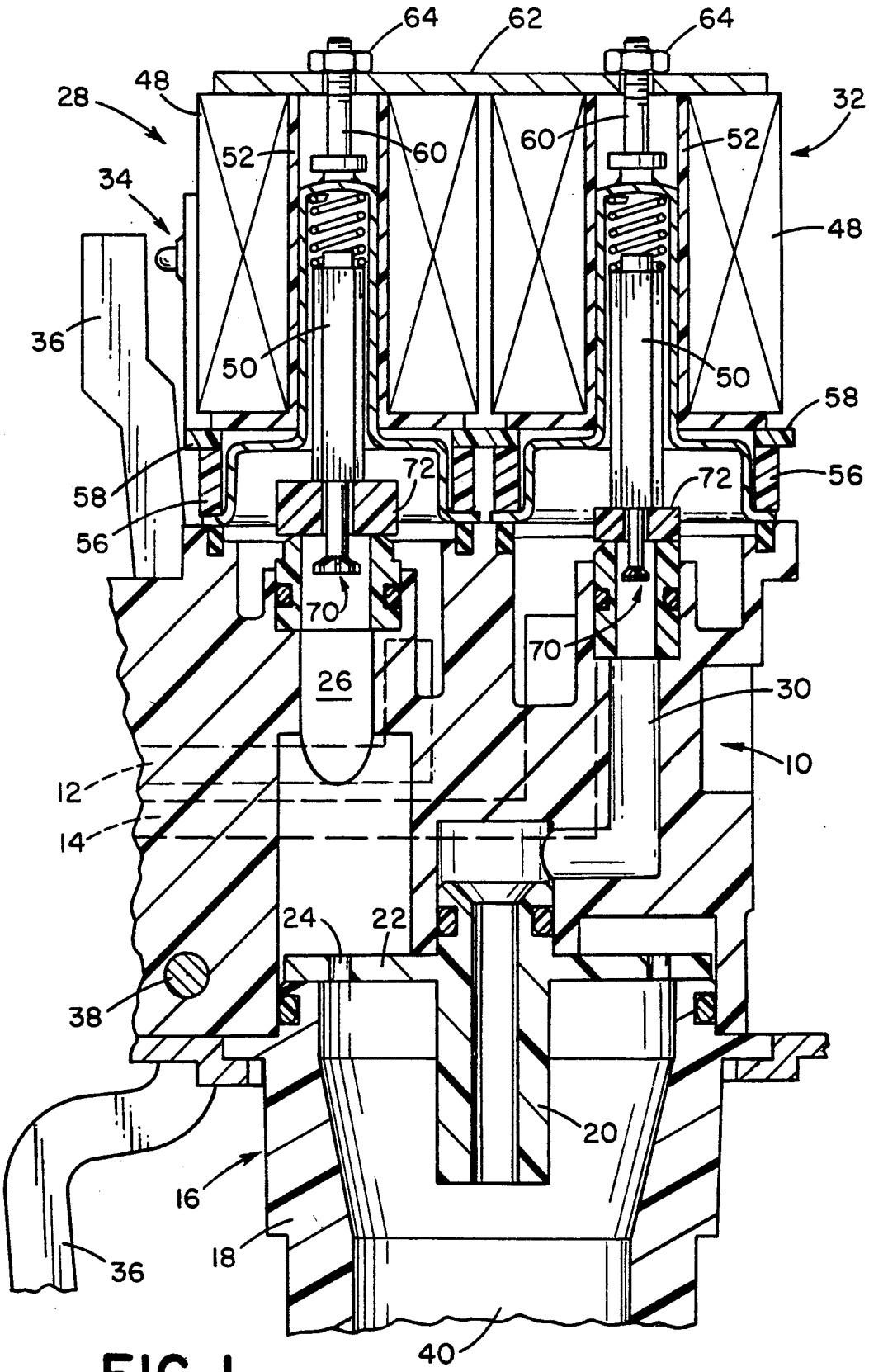
FIG. 1 is a fragmentary cross-sectional elevation view of a portion of a carbonated beverage dispenser incorporating solenoid valves in accordance with the present invention.

Referring now in greater detail to the drawings, wherein the showings are for the purpose of illustrating preferred embodiments of the invention only and not for limiting the invention, FIG. 1 shows a portion of the valve body 10 of a post-mix beverage dispenser having an inlet passageway 12 for a diluent such as soda water and an inlet passage 14 for a syrup to be mixed with the soda water. As is well known, each of the inlet passageways 12 and 14 is connected to a corresponding source of liquid under pressure through corresponding flow regulating valves, not shown, which control the rate of flow of the corresponding liquid through the dispenser when a drink is to be dispensed thereby.

Body 10 supports a nozzle assembly 16 which includes an outer shroud 18 and an inner syrup tube 20 which includes a diffuser plate 22 having openings 24 therethrough. As explained more fully hereinafter, soda water inlet passageway 12 is adapted to be connected in flow Communication with a soda water outlet passage 26 by a solenoid actuated valve assembly 28, and syrup inlet passageway 14 is adapted to be connected in flow communication with a syrup outlet passage 30 by a solenoid actuated valve assembly 32. Solenoid actuated valves 28 and 32 are normally de-energized and thus closed and, in a well known manner, are adapted to be simultaneously energized and thus open by a microswitch 34 actuated by a control lever 36 supported on body 10 for pivotal movement about a pin or the like 38. While not shown, the lower end of lever 36 terminates below and adjacent nozzle assembly 16 and is adapted to be engaged by a cup or the like positioned beneath the nozzle assembly to receive a dispensed drink. In this respect, as is also well known, the cup is pressed against lever 36 to pivot the latter clockwise in FIG. 1 about pin 38 whereby the upper end of the lever actuates microswitch 34 to simultaneously energize solenoid actuated valves 28 and 32 to open the latter. When the valves are open, soda water flows through outlet passage 26 and through openings 24 in diffuser plate 22 into space 40 between shroud 18 and syrup tube 20, and syrup flows through outlet passage 30 and thence through syrup tube 20 so as to mix with soda water in space 40 and flow therewith into the cup.

In accordance with the present invention, the flow control components of solenoid valve assemblies 28 and 32 are structured to control the flow of the corresponding liquid from the inlet passage therefor to the corresponding outlet passage in a manner which provides sequential and distinct first and second stages of pressure drop across the valve during the opening thereof. The structure and operation of the valves in this respect will be understood from the following description of valve 28 and with reference in particular to FIGS. 2–6. With the exception of dimensional differences, valves 28 and 32 are structurally identical whereby the component parts of valve assembly 32 are identified by like numerals in FIG. 1.

Referring now to FIGS. 2–6, soda water inlet passageway 12 opens into a chamber 42 which is on the upstream side of an annular valve seat insert 44 coaxial with outlet passage 26 and having a valve seat edge 46 transverse thereto. The solenoid valve assembly includes a solenoid coil 48 and an armature 50 coaxial with outlet passage 26. Coil 48 surrounds and armature 50 is slidably supported in an annular guide housing 52 which is sealed relative to chamber 42 and body 10 by an annular seal 54. The guide housing is secured to body 10 by an annular clamping ring 56 and an annular retaining ring 58 which is removably secured to body 10 by threaded fasteners, not shown. The closed upper end of guide 52 is provided with a threaded post 60 which extends through a retaining plate 62 common to both valves 28 and 32. Posts 60 receive lock nuts 64 by which coils 48 are removably secured in place.

Figure 3:
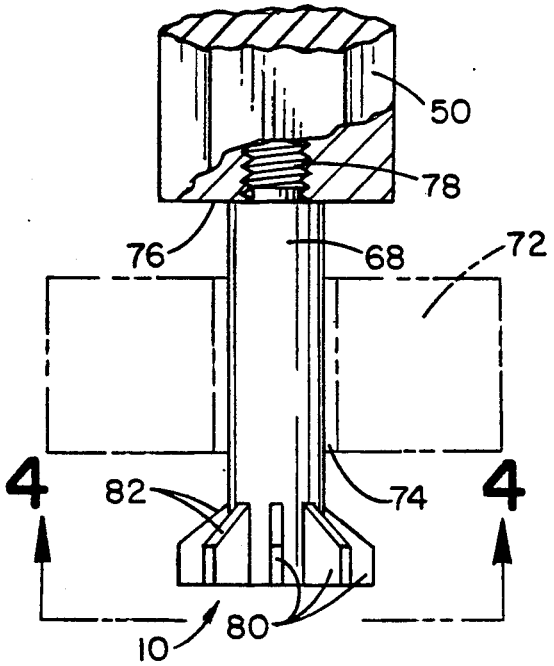
FIG. 3 is an enlarged elevation view of the lower portion of the armature of the solenoid valve shown in FIG. 2.
Figure 4:
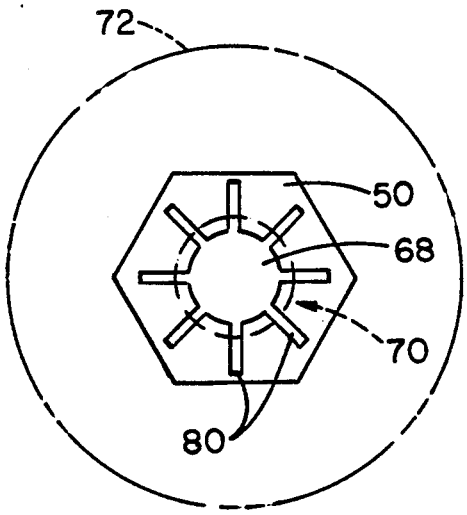
FIG. 4 is a bottom view of the armature as seen along line 4—4 in FIG. 3.

Armature 50 is hexagonal in cross-section and is biased downwardly toward seat insert 44 by a coil spring 66 between the upper end of the armature and the closed upper end of guide 52 and by the pressure of the liquid in chamber 42 acting against the upper end of the armature. As best seen in FIGS. 3 and 4, the lower end of armature 50 is provided with a stem 68 having a valve element retainer 70 on the lowermost end thereof for the purpose which will become apparent hereinafter. An annular valve element 72 of suitable resilient material surrounds stem 68 and has an outer diameter which provides for the valve element to engage and seal against seat edge 46. Valve element 72 has an inner diameter which is slightly greater than the diameter of stem 68 so as to provide an annular bypass space 74 therebetween. The inner diameter of the valve element is smaller than the minor cross-sectional dimension of hexagonal stem 50, whereby the radially extending shoulder 76 between the armature and stem 68 closes the upper end of bypass space 74 when the valve element is in the closed position shown in FIGS. 1 and 2. Valve element 72 has an axial thickness less than the distance between shoulder 76 and the upper end of retainer 70 so as to be axially displaceable relative to stem 68.

In the embodiment shown in FIGS. 3 and 4 of the drawing, retainer 70 is integral with stem 68 and the latter has a threaded upper end 78 threadedly interengaged with a threaded bore therefor in the lower end of armature 50. Retainer 70 is defined by a plurality of fingers 80 circumferentially spaced apart about stem 68 and extending radially outwardly therefrom a distance greater than the inner diameter of valve element 72. Preferably, upper surfaces 82 of fingers 80 are inclined outwardly and downwardly relative to stem 68 for the purpose set forth hereinafter.

Figure 2:
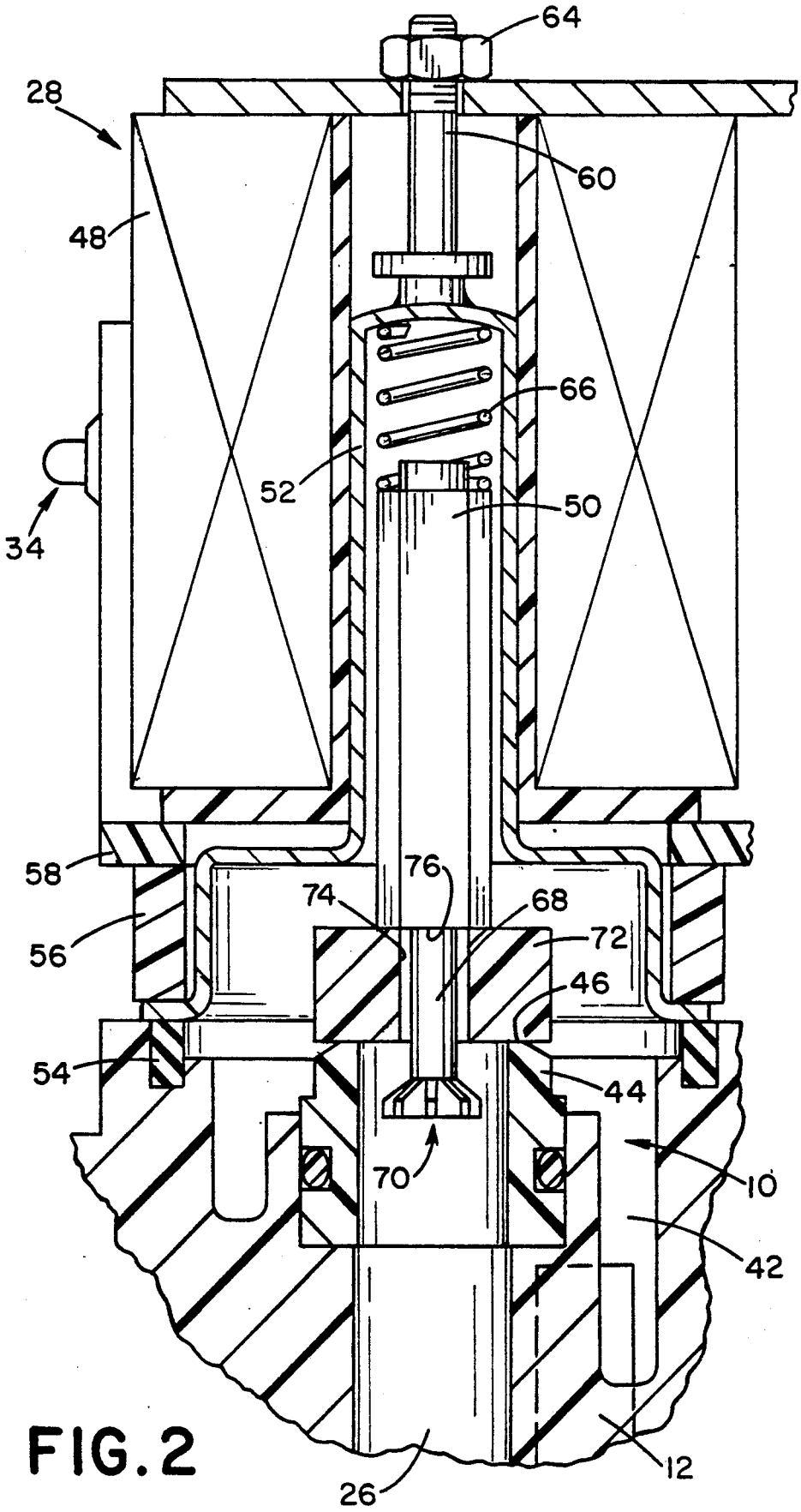
FIG. 2 is an enlarged sectional elevation view of one of the solenoid valves in FIG. 1 and showing the valve in the closed position.

When the valve is in the closed position shown in FIG. 2, valve element 72 is sealingly biased against seat edge 46 by spring 66 and the pressure of liquid in chamber 42 acting against the upper surface of the valve element and the upper end of armature 50. Shoulder 76 engages against the upper surface of the valve element to close bypass space 74 and, as will be appreciated from FIG. 2, stem 68 has a length which spaces retainer 70 below the bottom side of valve element 72. When the valve is actuated by energizing coil 48 to displace armature 50 upwardly in guide 52 to open the valve, armature 50 initially moves to the position shown in FIG. 5 of the drawing wherein shoulder 76 is elevated from the upper side of valve element 72, thus communicating chamber 42 with outlet passage 26 through bypass space 74. Valve element 72 remains in engagement with seat edge 46 by the pressure of the liquid acting against the upper side thereof, and a first stage of pressure drop across the valve seat is realized by the flow from chamber 42 through bypass space 74 into outlet passage 26. As will be appreciated from FIG. 5, the flow of liquid through bypass space 74 to outlet passage 26 is across retainer 70 through the spaces between fingers 80 thereof. As armature 50 continues to ascend in the opening direction, retainer 70 engages the underside of valve element 72 and lifts the latter from seat edge 46 as shown in FIG. 6 of the drawing. At this time, the valve is fully open whereby liquid in chamber 42 can flow radially across the valve seat and thence into the seat insert toward outlet passage 26. Furthermore, the liquid can flow across the valve element through clearance space 74 and across fingers 80 of retainer 70 through the spaces therebetween. As mentioned hereinabove, the upper surfaces of fingers 80 are inclined downwardly and outwardly relative to stem 68 and this advantageously promotes self-centering of valve element 72 relative to stem 68 when retainer 70 lifts the valve element from seat edge 46. When coil 48 is de-energized, spring 66 and the pressure of liquid in chamber 42 cooperatively bias armature 50 and valve element 72 back to the closed position thereof shown in FIG. 2.

Figure 5:
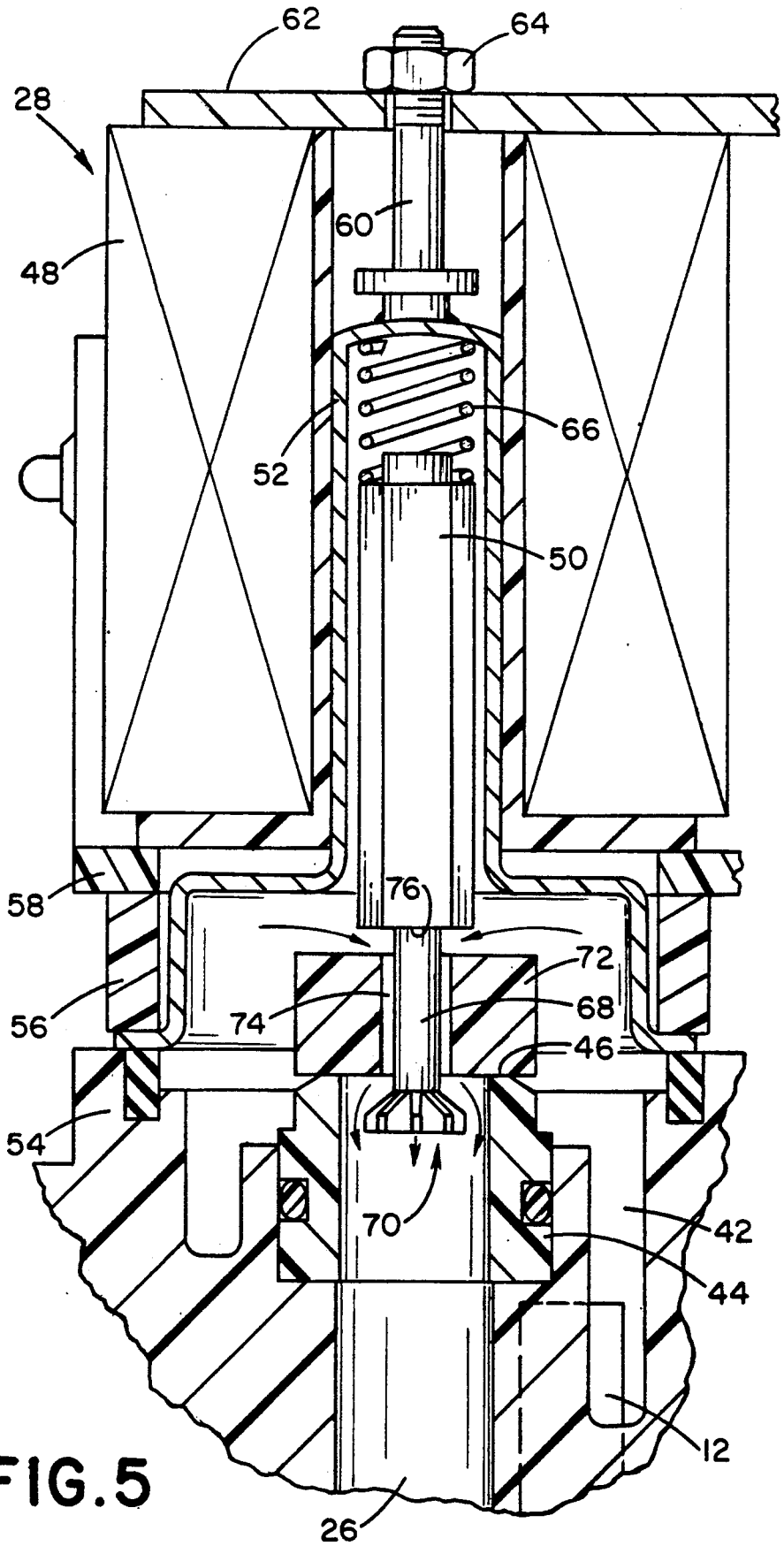
FIG. 5 is an enlarged sectional elevation view of the solenoid valve in FIG. 2 in the partially open position thereof.
Figure 6:
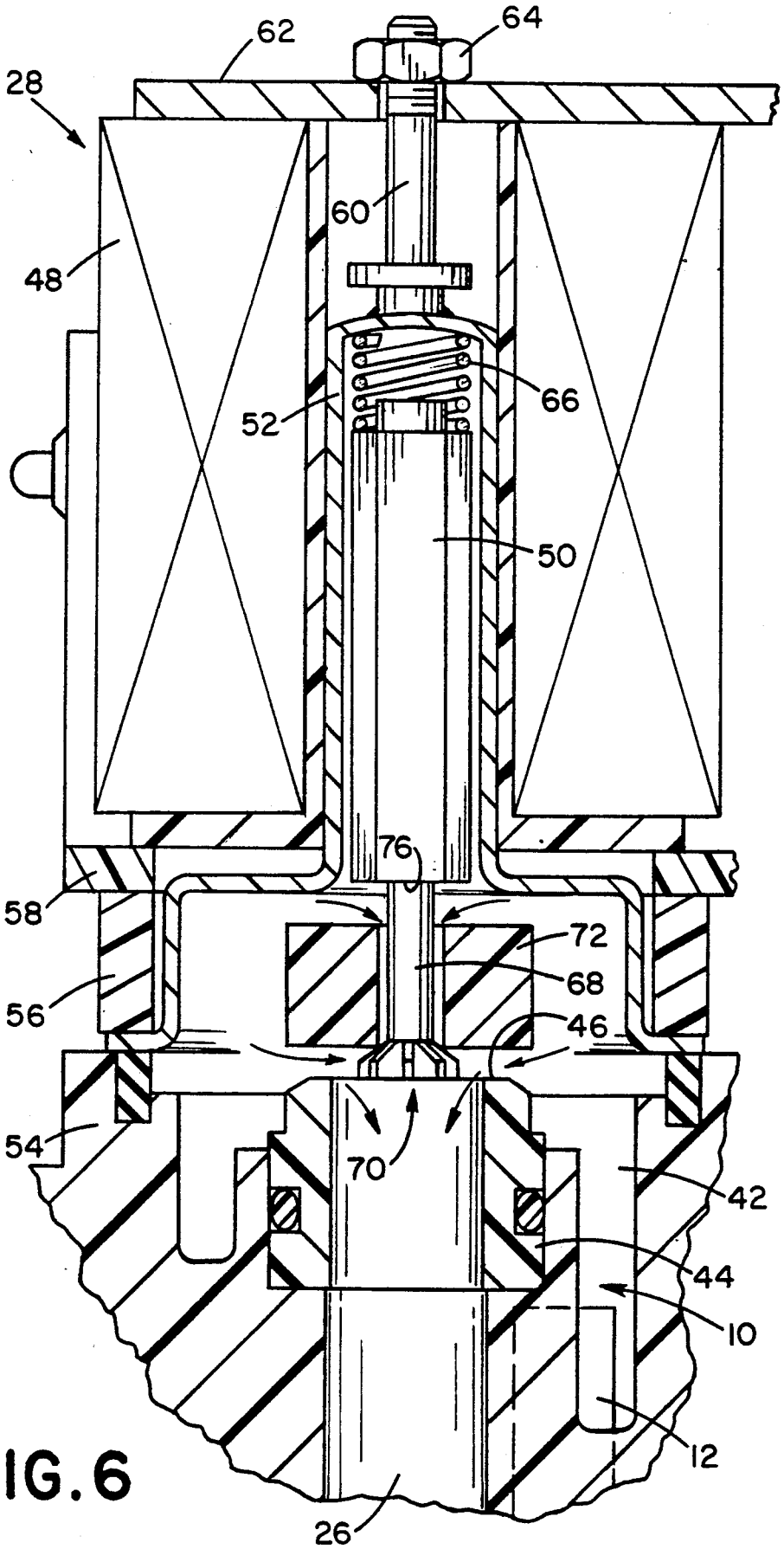
FIG. 6 is an enlarged sectional elevation view of the solenoid valve in FIG. 2 in the fully open position thereof.

It will be appreciated from the foregoing description that the initial pressure drop represented by the positions of component parts in FIG. 5 is achieved independent of the pressure of liquid in chamber 42 against valve element 72 and that the second stage of pressure drop represented by the positions of the component parts in FIG. 6 provides for the flow of fluid across the valve element during displacement thereof from seat edge 46 by the armature, thus to minimize the force against the upper surface of the valve element by the liquid under pressure during such opening movement. Accordingly, the power of the solenoid required to displace the armature is less than that which would be required if the valve element were axially fixed to the lower end of the armature. Thus, for a given liquid pressure the power requirement of the solenoid is reduced or, for a given solenoid, the liquid pressure at which it is operable is increased.

Figure 7:
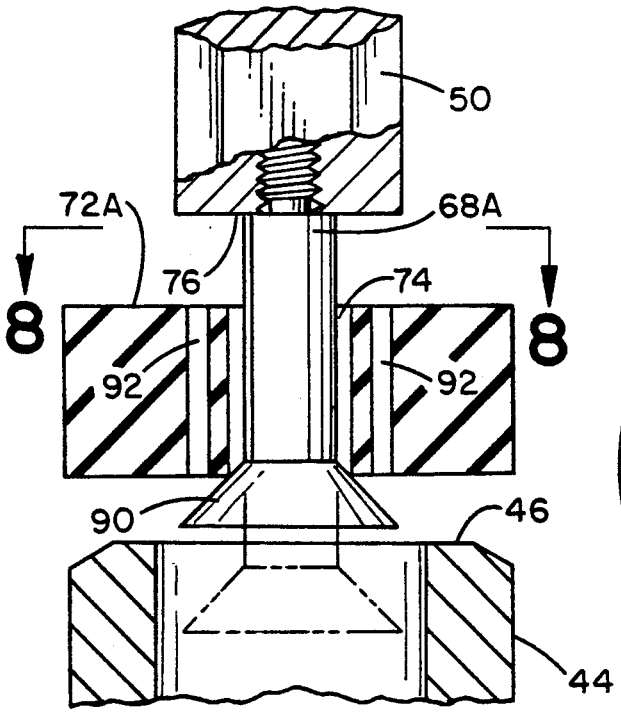
FIG. 7 is an elevation view, partially in section, of another embodiment of the armature and valve element.
Figure 8:
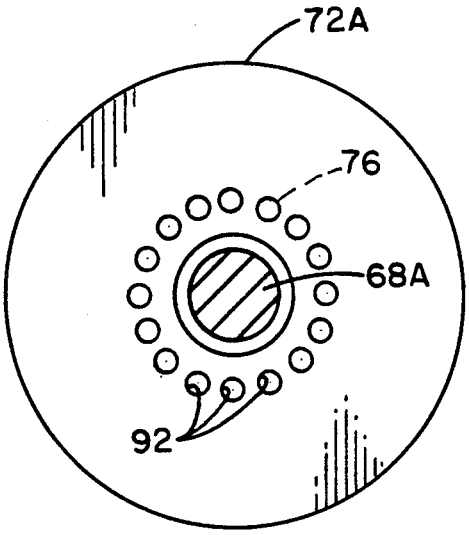
FIG. 8 is a plan view, in section, taken along line 8—8 in FIG. 7.

FIGS. 7 and 8 illustrate a modification of the arrangement by which the valve element retainer and valve element cooperate to provide the first stage of pressure drop. In this respect, the lower end of armature 50 is provided with a stem 68A having a radially outwardly flaring conical valve element retainer 90 on the lower end thereof. Valve element 72A is an annular valve element which, like valve element 72 described hereinabove, has an outer diameter greater than valve seat edge 46 and an inner diameter slightly greater than the diameter of stem 68A so as to provide an annular bypass space 74 therebetween. In this embodiment, retainer 90 is solid and valve element 72A is provided with a plurality of apertures 92 axially therethrough and radially located within the minor diameter of hexagonal armature 50. Accordingly, when the valve is closed shoulder 76 engages against the upper side of valve element 74A and closes both bypass space 74 and apertures 92. In the initial opening position of the armature corresponding to that shown in FIG. 5, liquid in chamber 42 can flow through bypass space 74 and through apertures 92 to outlet passage 26 and, in the fully open position corresponding to that shown in FIG. 6, retainer 90 elevates valve element 72A from seat edge 46 whereby liquid under pressure can flow radially across the valve seat and axially across the valve element through apertures 92.

While considerable emphasis has been placed on the embodiments illustrated and described herein, it will be appreciated that many embodiments of the invention can be made and that many changes can be made in the preferred embodiments without departing from the principles of the invention. Accordingly, it is to be distinctly understood that the foregoing descriptive matter is to be interpreted merely as illustrative of the invention and not as a limitation.

Having thus described the invention, it is claimed:

1. In a post-mix beverage dispenser comprising a liquid passageway, said liquid passageway having inlet and outlet ends, a valve seat in said passageway between said inlet and outlet ends, solenoid operated valve means for controlling the flow of liquid through said passageway across said valve seat, said solenoid operated valve means including a valve element, a solenoid and an armature for displacing said valve element relative to said valve seat, and support means for supporting said liquid passageway, said valve seat and said solenoid operated valve means, the improvement comprising: said valve element being supported on said armature, said armature having first, second and third positions relative to said valve seat, said armature in said first position engaging said valve element against said valve seat to close said liquid passageway, said armature and said valve element including means cooperable in said second and third positions of said armature for providing sequential and distinct first and second stages of pressure drop across said valve seat, said armature having an axis, said valve element including an opening axially thereacross, said armature including means for closing said opening when said armature is in said first position and for unclosing said opening when said armature is in said second and third positions, said valve element surrounding said armature in radially spaced relationship thereto to provide an annular space therebetween defining said opening thereacross, and said closing means on said armature including radially extending annular shoulder means for closing said annular space when said armature is in said first position.

2. A beverage dispenser according to claim 1, wherein said means cooperable in said second and third positions of said armature includes said opening across said valve element in said second position.

3. A beverage dispenser according to claim 2, wherein said means cooperable in said second and third positions of said armature includes means on said armature for disengaging said valve element from said valve seat in said third position.

4. A beverage dispenser according to claim 1, wherein said means cooperable in said second and third positions of said armature includes means on said armature for disengaging said valve element from said valve seat in said third position of said armature.

5. A beverage dispenser according to claim 1, wherein said means for unclosing said opening includes an end axially spaced from said shoulder means, said valve element surrounding said armature between said shoulder means and said end, and said end engaging said valve element for disengaging said valve element from said valve seat when said armature is in said third position.

6. A beverage dispenser according to claim 5, wherein said end includes at least one radially extending finger.

7. In a post-mix beverage dispenser comprising a liquid passageway having inlet and outlet ends, a valve seat in said passageway between said inlet and outlet ends having an axis, solenoid operated valve means for controlling the flow of liquid through said passageway across said valve seat, said solenoid operated valve means including a solenoid, an armature coaxial with said valve seat and axially reciprocable relative thereto between first and second positions, a valve element on said armature and displaceable thereby to respectively engage and disengage said valve seat in said first and second positions of said armature, and support means for supporting said passageway, said valve seat and said solenoid operated valve means, the improvement comprising: an opening across said valve element, said armature including means for closing said opening when said armature is in said first position and unclosing said opening when said armature is in said second position, means on said armature for displacing said valve element from said valve seat during movement of said armature from said first toward said second position, and means for mounting said valve element on said armature including a stem on said armature having a first diameter, said opening through said valve element receiving said stem and having a second diameter larger than said first diameter.

8. A beverage dispenser according to claim 7, wherein said opening across said valve element includes a space between said stem and said valve element provided by said first and second diameters, said means for closing said opening including shoulder means on said armature for closing said space in said first position of said armature.

9. A beverage dispenser according to claim 8, wherein said means on said armature for displacing said valve element from said seat includes an end on said stem spaced from said shoulder means having a diameter transverse to said axis greater than said second diameter.

10. A beverage dispenser according to claim 9, wherein said end includes at least one radially extending finger.

11. A beverage dispenser according to claim 9, and a plurality of apertures opening axially through said valve element radially outwardly of said opening.

12. In a post-mix beverage dispenser comprising a liquid passageway having inlet and outlet ends, a valve seat in said passageway between said inlet and outlet ends having an axis, and solenoid operated valve means for controlling the flow of a fluid through said passageway across said valve seat, said solenoid operated valve means including a valve element, a solenoid and an armature for displacing said valve element relative to said valve seat, the improvement comprising: said valve element being supported on said armature, said armature having first, second and third position relative to said valve seat, said armature in said first position engaging said valve element against said valve seat to close said passageway, and said armature and said valve element including means cooperable in said second and third positions of said armature for disengaging said valve element from said valve seat and providing sequential and distinct first and second stages of pressure drop across said valve seat, said valve element surrounding said armature in radially space relationship thereto to provide an annular space therebetween defining an opening thereacross, and said armature including radially extending annular shoulder means for closing said annular space when said armature is in said first position.

13. A beverage dispenser according to claim 12, wherein said means cooperable in said second and third positions of said armature means includes end means on said armature for engaging said valve element and disengaging said valve element from said valve seat, said end means including radially extending fingers spaced apart about said axis.

14. In a post-mix beverage dispenser comprising a passageway having inlet and outlet ends, a valve seat in said passageway between said inlet and outlet ends, solenoid operated valve means for controlling the flow of a fluid through said passageway across said valve seat, said solenoid operated valve means including a solenoid, an armature reciprocable relative to said valve seat between first and second positions, and a valve element on said armature and displaceable thereby to respectively engage and disengage said valve seat in said first and second positions of said armature, the improvement comprising: said valve element including an opening across said valve element, said armature including means for displacing said armature relative to said valve element for closing said opening when said armature is in said first position and unclosing said opening when said armature is between said first and second positions, means on said armature for displacing said valve element from said valve seat during movement of said armature from said first to said second position, a means mounting said valve element on said armature including a stem on said armature having a first diameter, and said opening through said valve element receiving said stem and having a second diameter larger than said first diameter.

15. A beverage dispenser according to claim 14, wherein said means on said armature for displacing said valve element from said seat includes an end on said stem having a diameter transverse to said axis greater than said second diameter.

16. A beverage dispenser according to claim 15, wherein said end includes at least one radially extending finger.

* * * * *